US008215754B2

(12) United States Patent
Akiyama

(10) Patent No.: US 8,215,754 B2
(45) Date of Patent: Jul. 10, 2012

(54) DETACHABLE STRUCTURE FOR INK CARTRIDGE, AND CONTROL METHOD FOR ATTACHING/DETACHING INK CARTRIDGE

(75) Inventor: Tomoyuki Akiyama, Ibaraki-ken (JP)

(73) Assignee: Riso Kagaku Corporation, Tokyo (JE)

( * ) Notice: Subject to any disclaimer, the term of this patent is extended or adjusted under 35 U.S.C. 154(b) by 380 days.

(21) Appl. No.: 12/588,031

(22) Filed: Oct. 1, 2009

(65) Prior Publication Data

US 2010/0085404 A1 Apr. 8, 2010

(30) Foreign Application Priority Data

Oct. 2, 2008 (JP) ..... P2008-257772

(51) Int. Cl.
*B41J 2/175* (2006.01)
*B41J 29/393* (2006.01)

(52) U.S. Cl. ..... 347/85; 347/19

(58) Field of Classification Search ..... 347/5, 7, 347/19, 49, 85
See application file for complete search history.

(56) References Cited

U.S. PATENT DOCUMENTS 7,479,975 B2 * 1/2009 Imamura et al. ..... 347/213
7,484,825 B2 * 2/2009 Asauchi ..... 347/19
7,850,263 B2 * 12/2010 Shinada et al. ..... 347/7
7,967,415 B2 * 6/2011 Asauchi et al. ..... 347/50
8,025,372 B2 * 9/2011 Umeda et al. ..... 347/85

FOREIGN PATENT DOCUMENTS

JP 2006-21398 A 1/2006

* cited by examiner

*Primary Examiner* — Anh T. N. Vo
(74) *Attorney, Agent, or Firm* — The Nath Law Group; Jerald L. Meyer

(57) ABSTRACT

A detachable structure for an ink cartridge in a printer includes a storing unit, an acquisition unit, a determining unit, and an ink supply control unit. The storing unit is provided on the ink cartridge and stores information on the ink cartridge. The acquisition unit is provided on the printer and acquires the information stored in the storing unit when the ink cartridge is attached onto the printer. The determining unit certifies validity of the information acquired by the acquisition unit. The ink supply control unit allows ink supply from the ink cartridge when the validity of the information is certified by the determining unit. According to the structure, versatility of ink cartridges can be ensured and productivity cost for ink cartridges can be restricted. In addition, prevented can be undesirable ink mixture due to an erroneous installation of the ink cartridge by a user.

10 Claims, 12 Drawing Sheets

DETACHABLE STRUCTURE FOR INK CARTRIDGE, AND CONTROL METHOD FOR ATTACHING/DETACHING INK CARTRIDGE

BACKGROUND OF THE INVENTION

1. Field of the Invention

The present invention relates to a detachable structure for an ink cartridge in a printer and a control method for attaching/detaching an ink cartridge in a printer.

2. Description of Related Art

In an inkjet printer, various types of inks are used such as a water-based type, an oil-based type and a UV type according to its printing usage. Since an image size to be printed becomes larger and thereby consumption amount of ink becomes larger in recent days, an ink cartridge tends to be replaced more frequently than before.

Compared with ink supplying through the ink supply needle, ink dripping from a joint tends to increase according to the above-mentioned joint mechanism. The ink dripping onto the ink cartridge, the inside of the printer and so on may taint user's hands and clothes or an attachment section of the ink cartridge in the printer. Especially, ink tends to drip off in a detachable structure of an ink cartridge as shown in FIGS. 11A and 11B.

However, coagulation or separation of inks may occur when different types of inks are mixed due to an erroneous attachment by a user. In addition, coagulation or separation of inks may sometimes occur when different colors of a type of ink are mixed. Therefore, mechanical troubles such as injection failures and plugs on an ink passageway may be sometimes brought unfortunately when different ink types or ink colors are used with a common type of an ink cartridge.

Some techniques for solving the above-mentioned issue were proposed. For example, Japanese Application Laid-open No. 2006-21398 (Patent Document 1) discloses color indicators that are provided on an ink cartridge and a printer and visible when the ink cartridge is installed on the printer. When the ink cartridge is installed on the printer appropriately, colors of their color indicators will be identical.

SUMMARY OF THE INVENTION

Here, attachment sections (joints) of the ink cartridge and the printer can be made to have paired shapes. The paired shapes are capable of being coupled with each other but differentiated per color in order to prevent an erroneous attachment of the ink cartridge.

However, the paired shapes need to be differentiated per colors. Therefore, different-shaped joint sections per different color are brought versatility degradation of ink cartridges. As a result, productivity of ink cartridges reduces and thereby their production costs may increase.

The present invention has been achieved in order to solve the above problems and an object of the present invention is to provide, for a printer such as an inkjet printer, a detachable structure for an ink cartridge and a control method for attaching/detaching ink cartridge that can ensure versatility of ink cartridges, and prevent incrementation of production costs and an erroneous mixture of inks on replacing ink cartridges.

A first aspect of the present invention provides a detachable structure for an ink cartridge in a printer. The structure includes a storing unit provided on the ink cartridge for storing information on the ink cartridge; an acquisition unit provided on the printer for acquiring the information stored in the storing unit when the ink cartridge is attached onto the printer; a determining unit for certifying validity of the information acquired by the acquisition unit; and an ink supply control unit for allowing ink supply from the ink cartridge when the validity of the information is certified by the determining unit.

According to the first aspect of the present invention, the validity of the ink cartridge is judged based on the information on the ink cartridge stored in the storing unit. If it is judged that the information is valid, ink supply from the cartridge is allowed. If it is judged that the information is invalid, ink supply is prohibited by, for example, preventing the ink cartridge from coupling with an installation portion on the printer. Therefore, prevented can be undesirable ink mixture due to an erroneous installation of the ink cartridge by a user.

It is preferable that the ink supply control unit includes a joint section to be coupled with an ink supply port of the ink cartridge; a joint coupling unit for coupling the joint section with the ink supply port when the validity of the information is certified by the determining unit; a state holding unit for holding a coupled state of the joint section and the ink supply port; and an uncoupling unit for uncoupling the coupled state by separating the joint section from the ink supply port when the state holding unit stops holding.

In this case, the joint coupling unit is driven to move the joint section when it is judged that the information is valid. Then, the joint section is coupled with the ink supply port. On the other hand, the joint coupling unit is not driven when it is judged that the information is invalid. Therefore, prevented can be undesirable ink mixture due to an erroneous installation of the ink cartridge by a user. In addition, once the installed ink cartridge is detached, another ink cartridge can be attached to the printer correctly only after the validity of the other ink cartridge is certified. As a result, even in a case where electrical power supply is shut down and thereby the validity cannot be certified by an electrical communication or information processing, prevented can be undesirable ink mixture due to an erroneous installation of the ink cartridge by a user.

It is preferable that the state holding unit starts to hold the coupled state of the joint section and the ink supply port by an attachment force of the ink cartridge onto the printer.

In this case, the state holding unit starts to hold the coupled state by utilizing the attachment force of the ink cartridge. Since the attachment force generated by a user's manual operation can be utilized effectively, no additional special drive force is needed to couple the ink cartridge with the joint section.

It is preferable that the uncoupling unit separates the joint section from the ink supply port when the state holding unit stops holding due to detachment of the ink cartridge from the printer.

In this case, the state holding unit stops holding when the ink cartridge is detached by utilizing the detachment force generated by a user's manual operation. As a result, the uncoupling unit separates the joint section from the ink supply port. Once the installed ink cartridge is detached, another ink cartridge can be attached to the printer correctly only after the validity of the other ink cartridge is certified. As a result, prevented can be undesirable ink mixture due to an erroneous installation of the ink cartridge by a user.

It is further preferable that the joint coupling unit is made distanced with the joint section after the state holding unit starts holding the coupled state of the joint section and the ink supply port, and the uncoupling unit is deformed under the coupled state and separates the joint section from the ink supply port by a restoring force thereof.

In this case, the joint coupling unit can hold the coupled state of the joint section and the ink supply port even after the joint coupling unit is separated from the joint section. Therefore, stable ink supplying can be ensured. In addition, when the ink cartridge is detached, the joint section is separated from the ink supply port by the restoring force of the uncoupling unit. Another ink cartridge can be attached correctly only after the validity of the other ink cartridge is certified. Therefore, even in a case where electrical power supply is shut down and thereby the validity cannot be certified by an electrical communication or information processing, prevented can be undesirable ink mixture due to an erroneous installation of the ink cartridge by a user.

A second aspect of the present invention provides a control method for attaching/detaching ink cartridge in a printer. The method includes (a) storing information on the ink cartridge in a storing unit provided on the ink cartridge; (b) acquiring, on the printer, the information stored in the storing unit when the ink cartridge is attached onto the printer; (c) certifying, on the printer, validity of the acquired information; and (d) allowing ink supply from the ink cartridge when the validity of the information is certified in the (c).

According to the second aspect of the present invention, the validity of the ink cartridge is judged based on the information on the ink cartridge stored in the storing unit. If it is judged that the information is valid, ink supply from the cartridge is allowed. If it is judged that the information is invalid, ink supply is prohibited by, for example, preventing the ink cartridge from coupling with an installation portion on the printer. Therefore, prevented can be undesirable ink mixture due to an erroneous installation of the ink cartridge by a user.

It is preferable that the (d) further includes (d-1) moving a joint section of the printer toward an ink supply port of the ink cartridge to couple the joint section with the ink supply port after the validity of the information is certified in the (c), and (d-2) holding a coupled state of the joint section and the ink supply port using a state holding unit; and that the control method further comprises (e) uncoupling the coupled state by separating the joint section from the ink supply port when the state holding unit stops holding.

In this case, the joint section is moved toward the ink supply port after the validity of the information is certified. Then, the joint section is coupled with the ink supply port. On the other hand, the joint section is not moved toward the ink supply port when the validity of the information is not certified. Therefore, prevented can be undesirable ink mixture due to an erroneous installation of the ink cartridge by a user. In addition, once the installed ink cartridge is detached, another ink cartridge can be attached to the printer correctly only after the validity of the other ink cartridge is certified. As a result, even in a case where electrical power supply is shut down and thereby the validity cannot be certified by an electrical communication or information processing, prevented can be undesirable ink mixture due to an erroneous installation of the ink cartridge by a user.

It is further preferable that the state holding unit, in the (d-2), starts to hold the coupled state of the joint section and the ink supply port by an attachment force of the ink cartridge onto the printer.

In this case, the state holding unit starts to hold the coupled state by utilizing the attachment force of the ink cartridge. Since the attachment force generated by a user's manual operation can be utilized effectively, no additional special drive force is needed to couple the ink cartridge with the joint section.

It is further preferable that the joint section is, in the (e), separated from the ink supply port when the state holding unit stops holding due to detachment of the ink cartridge from the printer.

In this case, the state holding unit stops holding when the ink cartridge is detached by utilizing the detachment force generated by a user's manual operation. As a result, the joint section is separated from the ink supply port. Once the installed ink cartridge is detached, another ink cartridge can be attached to the printer correctly only after the validity of the other ink cartridge is certified. As a result, prevented can be undesirable ink mixture due to an erroneous installation of the ink cartridge by a user.

It is further preferable that an uncoupling unit is provided on the printer for achieving the (e), and the uncoupling unit is deformed under the coupled state and separates, in the (e), the joint section from the ink supply port by a restoring force thereof.

The joint section is separated from the ink supply port by the restoring force of the uncoupling unit when the ink cartridge is detached. Another ink cartridge can be attached correctly only after the validity of the other ink cartridge is certified. Therefore, even in a case where electrical power supply is shut down and thereby the validity cannot be certified by an electrical communication or information processing, prevented can be undesirable ink mixture due to an erroneous installation of the ink cartridge by a user.

As described above, according to the structure or the method of the present invention, versatility of ink cartridges can be ensured and productivity cost for ink cartridges can be restricted. In addition, prevented can be undesirable ink mixture due to an erroneous installation of the ink cartridge by a user.

DETAILED DESCRIPTION OF THE EMBODIMENTS (General Configuration of Printer)

One embodiment of a detachable structure for an ink cartridge according to the present invention will be explained with reference to the drawings. A printer 100 having the detachable structure is an inkjet type color line printer. The printer 100 includes a plurality of ink heads each has a number of nozzles. Printing is done line by line by ejecting black and/or color ink drops from the nozzles onto a printing paper (sheet) on a feeding belt so as to overlap images each other.

Four of the four ink heads are aligned and provided for yellow (Y), magenta (M), cyan (C) and black (K) inks for forming color images so as to overlap images formed by the respective ink heads. A processing device 330 is provided within the printer 100. The processing device 330 controls the above-mentioned printing processes by the ink heads, a drive control of a feed mechanism, a supply control of inks supplied from ink cartridges 200 and so on.

The processing device 330 is a processing module composed of processors such as a CPU, a DSP (Digital Signal Processor) and so on, memories, other hardwares such as electronic circuits, softwares such as programs implementing functions of the above-mentioned components, or combinations thereof. The processing device 330 virtually builds various functional modules by arbitrarily loading and executing programs. The processing device 330 also executes processes of image data, controls of components' operations and various processes against user's operations using the built functional modules. Further, an operation panel 340 is connected to the processing device 330. User's instructions and setting operations can be accepted via the operation panel 340.

Figure 1A:
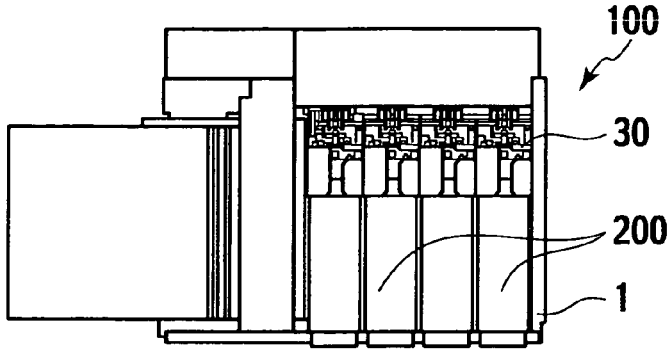
FIG. 1A is a plan view of a printer having a detachable structure for an ink cartridge according to an embodiment of the present invention.
Figure 1B:
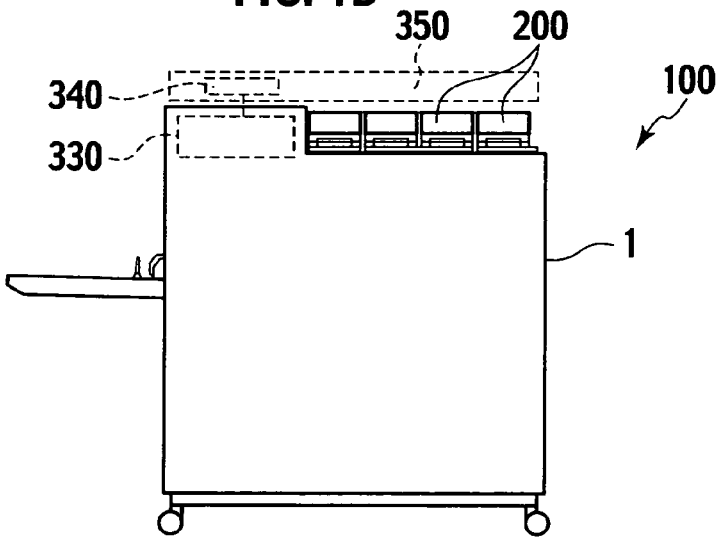
FIG. 1B is a front view of the printer having the detachable structure according to an embodiment of the present invention.
Figure 1C:
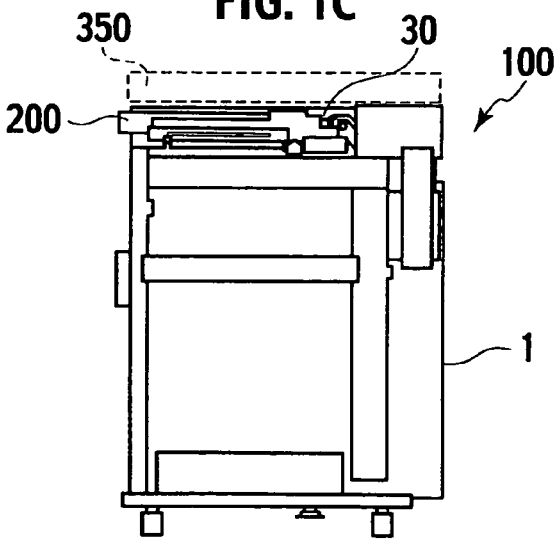
FIG. 1C is a right side view of the printer having the detachable structure according to an embodiment of the present invention.

As shown in FIG. 1A, a cartridge attaching mechanism 30 for the ink cartridges 200 is provided in the printer 100. As shown in FIGS. 1A and 1B, the ink cartridges 200 are attached onto the cartridge attaching mechanism 30 from a front side of the printer 100. The ink cartridges 200 for the above-mentioned colors are installed onto the cartridge attaching mechanism 30 with being aligned. In addition, an upper unit 350 is provided so as to cover the cartridge attaching mechanism 30. The ink cartridges 200 are installed by being horizontally inserted into spaces between a bottom face of the upper unit 350 and a top face of a main body 1 of the printer 100. The operation panel 340, a sheet feeder and so on are provided on the upper unit 350.

Figure 2A:
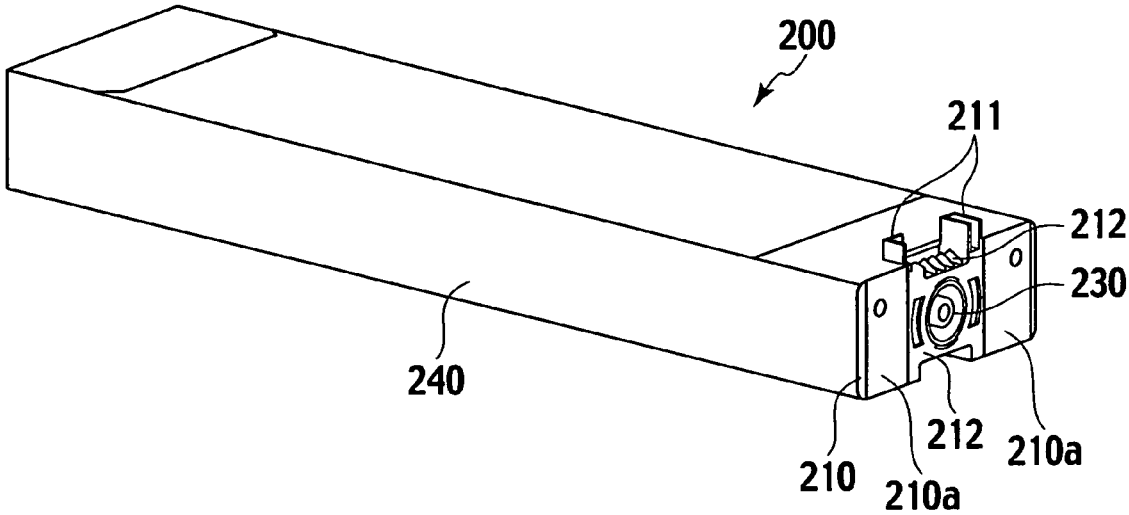
FIG. 2A is a perspective view showing an appearance of the ink cartridge.
Figure 3:
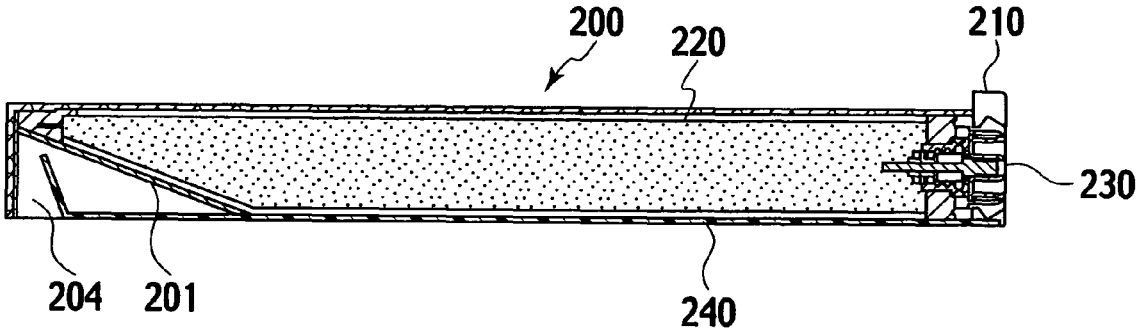
FIG. 3 is a cross-sectional view of the ink cartridge.

As shown in FIG. 2A, each of the ink cartridges 200 has a brick-like long shape and is horizontally attached-to or detached-from the printer 100. As shown in FIG. 3, each of the ink cartridges 200 mainly composed of an ink container 220 and an outer package 240. The ink container 220 is filled with ink and inserted within the outer package 240.

Figure 2B:
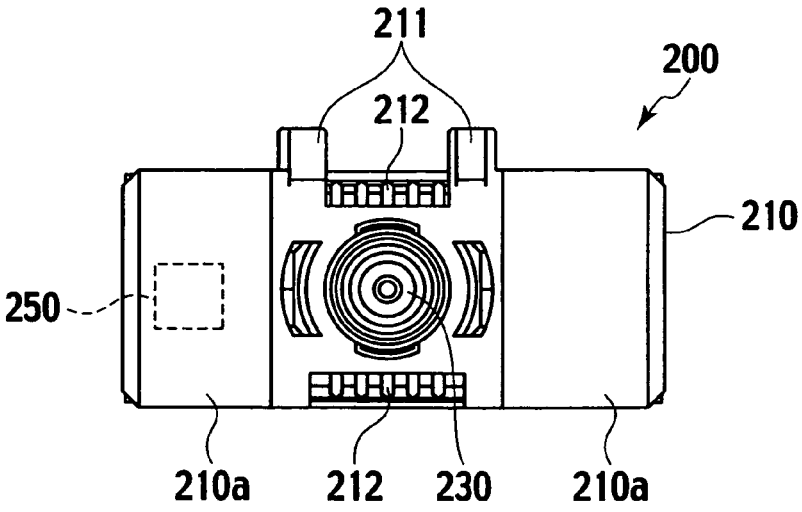
FIG. 2B is a side view of the ink cartridge showing its connecting section that is to be connected with the printer.

The outer package 240 is a tubular casing that has a rectangular cross sectional shape. As shown in FIG. 2B, a horizontal-to-vertical ratio of the outer package 240 in the present embodiment is about 2:1. The horizontal-to-vertical ratio is a ratio of a lateral-direction side parallel to a horizontal plane including an insertion direction to a longitudinal-direction side perpendicular to the horizontal plane. In addition, a connecting plate 210 is attached on one side plane of the outer package 240 and is to be connected the cartridge attaching mechanism 30 of the printer 100. The connecting plate 210 is made of hard material such as resin and metal. The connecting plate 210 is a contacted plane that is to be contacted with the cartridge attaching mechanism 30.

The connecting plate 210 has an ink supply port 230 on its center. Contacting plates 210*a* are provided on right and left sides of the supply port 230. The contacting plates 210*a* are made of resin, metal or the like and embedded on the one side plane of the tubular outer package 240. The contacting plates 210*a* are fixed on the outer package 240 by adhesive paper labels.

Connectors 212 are provided on upper and lower sides of the supply port 230 (on upper and lower centers of the connecting plate 210). The connectors 212 are to be held by holding units (a cartridge pawl 411*a* described later) provided on the printer 100. Triangular ribs are aligned on the connectors 212. The triangular ribs of the connectors 212 are snapped into slits or grooves provided on the holding units and then held due to elastic forces of the holding units.

A pair of tabs 211 is projected upward from an upper edge of the connecting plate 210. The pair of tabs 211 is provided only on one side in order to avoid confusion of upper and bottom sides on attaching the ink cartridge 200 onto the printer 100. In addition, the tabs 211 are detected by a detecting sensor(s) provided in the printer 100 while the ink cartridge 200 is installed in the printer 100. Specifically, the detecting sensor is a light-receiving sensor and detects a presence of an object when light is interrupted by the object. The tabs 211 approach toward the light-receiving sensor while the ink cartridge 200 is installed and then completion of the instillation is detected when the light-receiving is interrupted.

Further, a communication tag (storing unit) 250 is attached on the connecting plate 210 to communicate wirelessly with a wireless communication interface (I/F) 430 provided in the printer 100. The communication tag 250 generates an electrical power in its inside due to radio waves received from the wireless communication I/F 430. The communication tag 250 reads data out form its memory or writes data into the memory using the electrical power and sends/receives data via its antenna. In the present embodiment, ink color, oil/water-base of ink, attach/detach frequency or the like is stored in the memory. The wireless communication I/F 430 starts to communicate when the completion of the instillation on the cartridge attaching mechanism 30 is detected and data stored in the communication tag 250 are sent to the printer 100 (or data stored in the printer 100 are sent to the ink cartridge 200).

On the other hand, the outer package 240 is made of soft material such as paper and woody material and can be cut or bent. In the present embodiment, a recess 204 is provided on a bottom of the outer package 240 and positioned a counter side against the connecting plate 210, as shown in FIG. 3. The recess 204 functions as a handle when pulling the ink cartridge 200. In the present embodiment, the recess 204 is a hole that penetrates the bottom of the outer package 240 and communicates with an inner space of the outer package 240. The hole is formed by cutting around a part of the outer package 240 and bending the part inward.

A partition 201 is provided in the outer package 240 to form an inner space in which a flat end of the ink container 220 is held. The inner space formed by the partition 201 has a triangular longitudinal cross-sectional shape, as shown in FIG. 3 and located inward (behind) the recess 204. Note that the bent part for forming the recess 204 is located within the inner space.

Figure 4A:
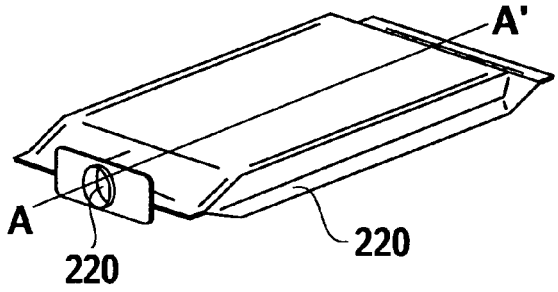
FIG. 4A is a perspective view showing an ink container of the ink cartridge.
Figure 4B:
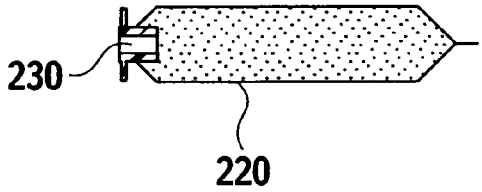
FIG. 4B is a cross-sectional view of the ink container.
Figure 4C:
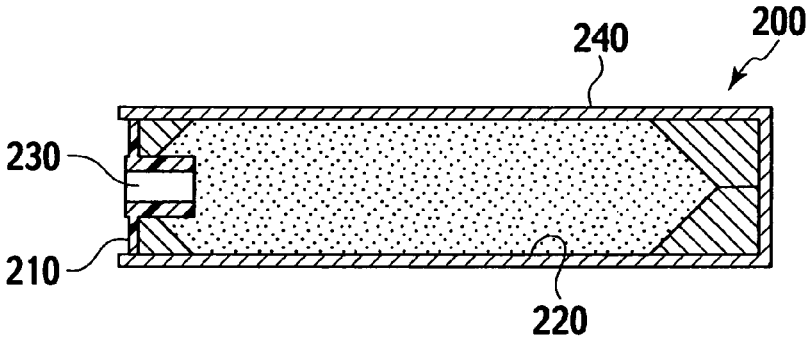
FIG. 4C is a cross-sectional view of the ink container that is set in the cartridge.

As shown in FIG. 4A, the ink container 220 is a bag that is filled with ink. In the present embodiment, the ink container 220 is made by heat-adhering four films so as to form its four side faces, respectively. Fold lines are made at its four adhesion sides due to the heat-adhesion. The ink container 220 has a rectangular cross-sectional shape when it is filled with ink. The rectangular cross-sectional shape of the ink container 220 corresponds to the rectangular cross-sectional inner shape of the outer package 240.

In addition, both ends of the ink container 220 at which its upper and bottom films are heat-adhered forms the flat ends. The flat ends are parallel to the horizontal plane. Further, each side face of the ink container 220 has a bending line. Therefore, the ink container 220 will become flat by bending its side faces along the bending lines, as the ink contained therein will be expended. Finally, the ink container 220 will become a flat shape that includes the both flat ends and the bending lines.

Furthermore, the ink supply port 230 is attached on one end of the ink container 220. The ink supply port 230 is mounted at the center of the above-mentioned connecting plate 210 to form a part of the connecting plate 210 under a state where the ink container 220 is held within the outer package 240. Under the above-mentioned held state, the ink supply port 230 is projected in an insertion direction in which the ink container 220 is inserted into the outer package 240. The ink supply port 230 will be attached-to or detached-from a cartridge holder 310 of the printer 100. The cartridge holder 310 is provided for each of the ink cartridge 200.

Figure 5A:
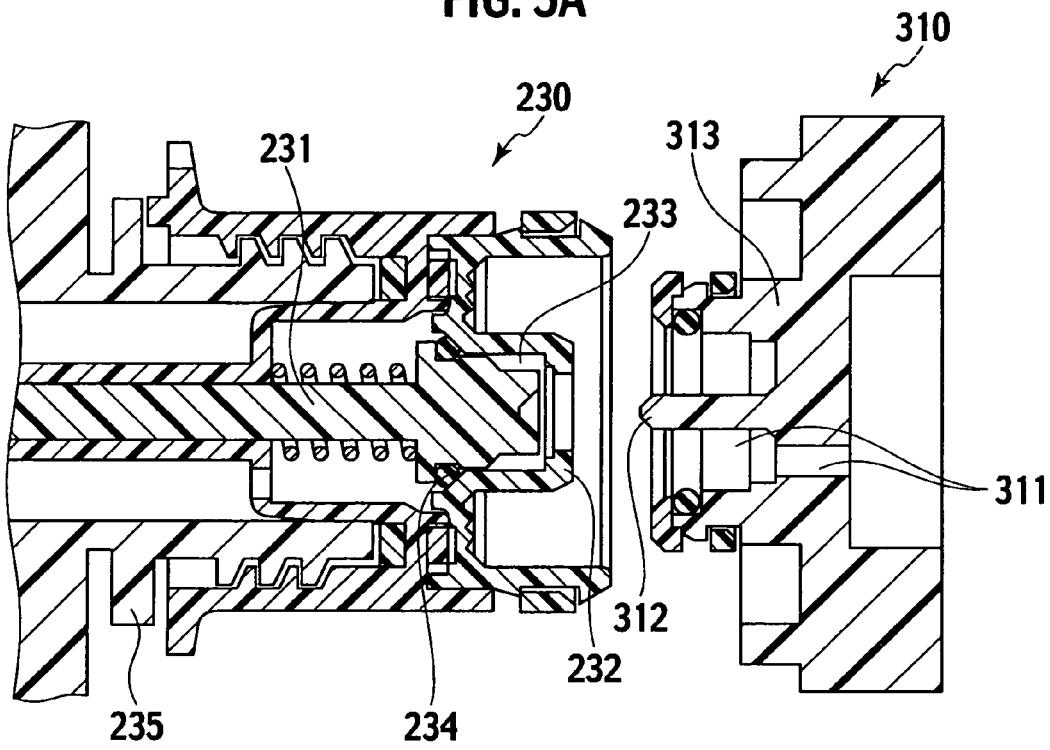
FIG. 5A is a cross-sectional view of joint sections (detached state)
Figure 5B:
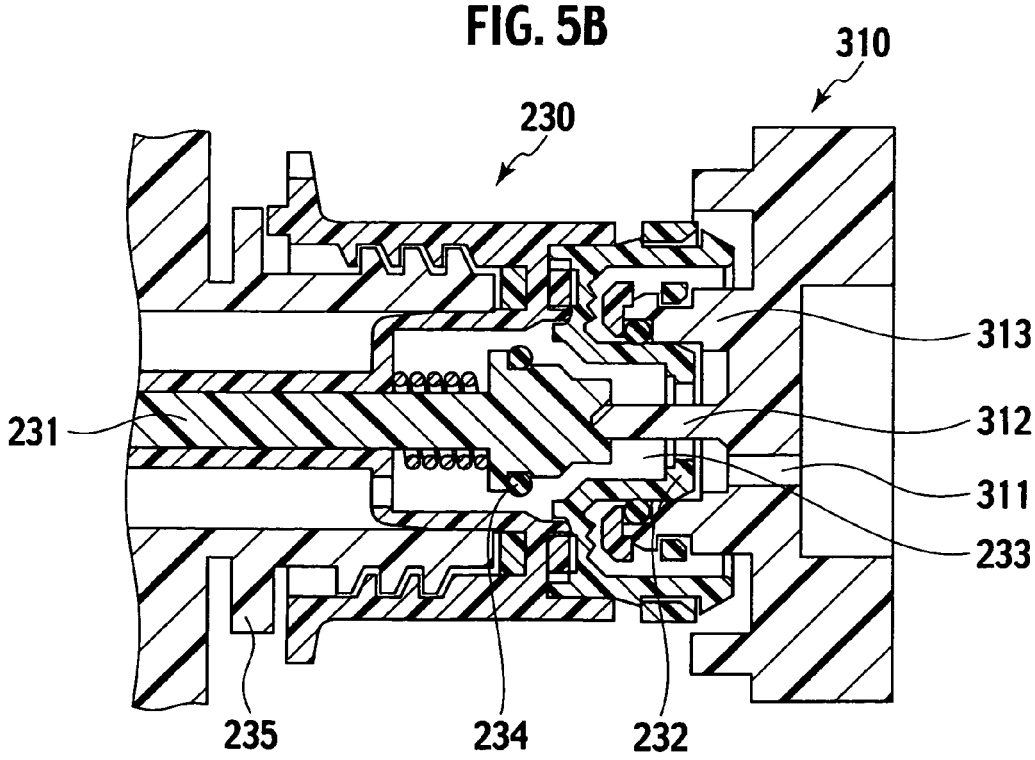
FIG. 5B is a cross-sectional view of the joint sections (attached state)

As shown in FIGS. 5A and 5B, the ink supply port 230 is mainly composed of a joint section 232 and the inner plunger 231. The inner plunger 231 is pressed outward by an inner pressure from the inside of the joint section 232 to close the ink supply port 230.

The ink supply port 230 composes the detachable structure that is to be coupled with the cartridge holder 310 of the printer 100. According to the detachable structure, the ink cartridge 200 and the printer 100 is connected each other and then ink is supplied from the ink cartridge 200 to the printer 100.

The cartridge holder 310 includes a joint section 313 that is to be coupled with the joint section 232 of the supply port 230 so as to enfold the joint section 232 therein. An ink path 311 is provided within the joint section 313. The ink path 311 communicates with the ink supply port 230 of the ink cartridge 200 while the joint sections 230 and 313 are coupled with each other The insertion rod 312 is provided along (within) the ink path 311 of the cartridge holder 310. The insertion rod 312 is projected toward the ink supply port 230 and inserted into the joint section 232 under a coupled state of the ink supply port 230 and the cartridge holder 310 to push the inner plunger 231 into the joint section 232. When the inner plunger 231 is pushed into the joint section 232, an ink flow path 233 that is communicated with the ink path 311 is opened through the inside of the joint section 232 of the ink supply port 230.

According to the above described detachable structure of the ink cartridge, supplying ink from the ink cartridge 200 installed on the main body 1 of the printer 100 is achieved by the detachable structure that is composed of the ink supply port 230 and the cartridge holder 310.

Figure 6:
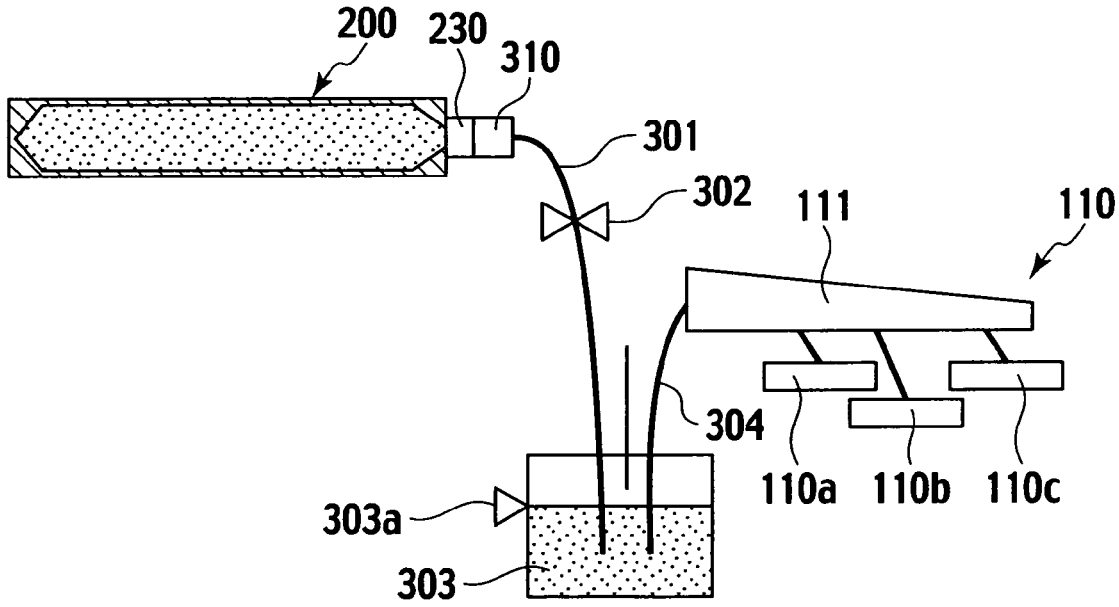
FIG. 6 is a schematic diagram showing an ink supply system in the embodiment.

As shown in FIG. 6, ink from the ink cartridge 200 is introduced into an ink tank 303 (also called as a reserver) through an ink supply path 301. An electromagnetic valve 302 is provided on the ink supply path 301 to open/close a flow path of the ink supply path 301 and control a flow amount of the ink through the ink supply path 301. A fluid level sensor 303 is provided within the ink tank 303 to measure the introduced ink amount by sensing fluid level within the ink tank 303. Note that ink is supplied from the ink cartridge 200 provided at a high position to the ink tank 303 provided at a low position due to a so-called siphon principle.

The introduced ink into the ink tank 303 is delivered to a distributor 111 in a head unit 110 through a supply path 304 and then distributed to ink heads 110*a*, 110*b*, 110*c*, . . . by the distributor 111 so as to be served for printing processes. In addition, a temperature sensor (not shown) is provided within the distributor 111 to detect ink temperature. Therefore, the temperature of ink that is just supplied to the ink heads 110*a*, 110*b*, 110*c* . . . can be detected.

(Detachable Structure for Ink Cartridge in Printer)

Figure 7:
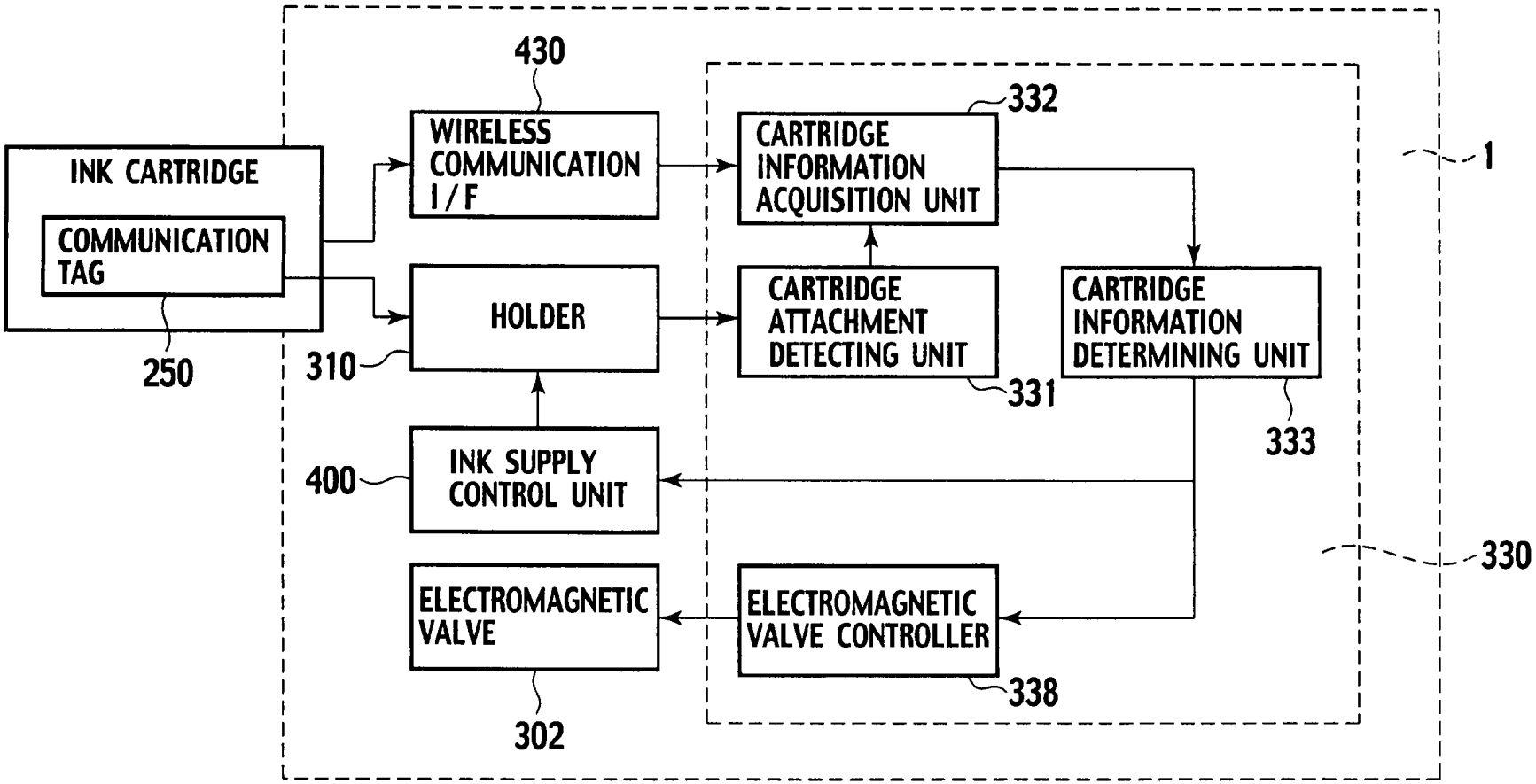
FIG. 7 is a block diagram of a functional module that is virtually configured in a processing device 330 in charge of a cartridge management.

The detachable structure for an ink cartridge in the printer 100 configured as described above will be controlled by the processing device 330. FIG. 7 is a block diagram of a functional module that is virtually constructed in the processing device 330 in charge of controlling the detachable structure.

As shown in FIG. 7, with respect to controlling the detachable structure, a cartridge information acquisition unit 332, a cartridge attachment detecting unit 331, a cartridge information determining unit 333 and an electromagnetic valve controller 338 are virtually configured in the processing device 330.

The cartridge attachment detecting unit 331 is a module for detecting the ink cartridge 200 being coupled with the holder 310 of the cartridge attaching mechanism 30 via detecting sensors provided on the holder 310. On detecting the ink cartridge 200 being coupled with the cartridge attaching mechanism 30, the cartridge attachment detecting unit 331 commands the cartridge information acquisition unit 332 to start wireless communication.

The cartridge information acquisition unit 332 a module for receiving information stored in the communication tag 250 as data via the wireless communication I/F 430. This data acquisition by the cartridge information acquisition unit 332 is started according to a detection of cartridge attachment by the detecting unit 331. The acquired data is input into the cartridge information determining unit 333. The wireless communication I/F 430 provided in the printer 100 is an interface for transmitting cartridge information stored in the communication tag 250 when the attachment of the ink cartridge 200 is installed in the printer 100.

The cartridge information determining unit 333 is a module for determining whether respective cartridge information obtained by the cartridge information acquisition unit 332 is valid and then analyzing/extracting the information. Here, it is first determined whether or not each ink cartridge 200 has been coupled with an appropriate holder 310 according to its type such as color, water-based and oil-based. If the ink cartridge 200 has been coupled with the appropriate holder 310, the cartridge information determining unit 333 notifies the fact to an ink supply control unit 400 and the electromagnetic valve controller 338. If the ink cartridge 200 has been installed erroneously, an error message is output via the operation panel 340. The electromagnetic valve controller 338 is a module for controlling open/close of the electromagnetic valve 302 provided on the ink supply path 301.

The ink supply control unit 400 is a mechanism for driving the detachable structure on the holder 310 by electrical/mechanical operations. The operations will be explained hereinafter with reference to FIGS. 8A to 11B.

The ink supply control unit 400 is a mechanism for enabling ink supply from the ink cartridge 200 when the cartridge information determining unit 333 determines that the information stored in the communication tag 250 on the ink cartridge 200 is valid. Specifically, the ink supply control unit 400 includes the holder 310 capable of being driven toward the ink supply port 230 of the ink cartridge 200, a coupling cam 413 for coupling the holder 310 with the ink supply port 230, a joint lock plate 411 for holding the coupled state between the holder 310 and the ink supply port 230, and a return spring 415 for separating the holder 310 from the ink supply port 230 upon unlocking the joint lock plate 411, as shown in FIGS. 8A and 8B.

The joint lock plate 411 functions as a state holding unit for holding the coupled state between the holder 310 and the ink supply port 230. The joint lock plate 411 is moved to a position of the coupled state due to an insertion force of the ink cartridge 200. Specifically, the joint lock plate 411 includes a cartridge pawl 411*a* and a holder pawl 411*b* that function as portions for holding the coupled state. The joint lock plate 411 is supported swingably with a support point 411*c* being as its swinging center.

Figure 8A:
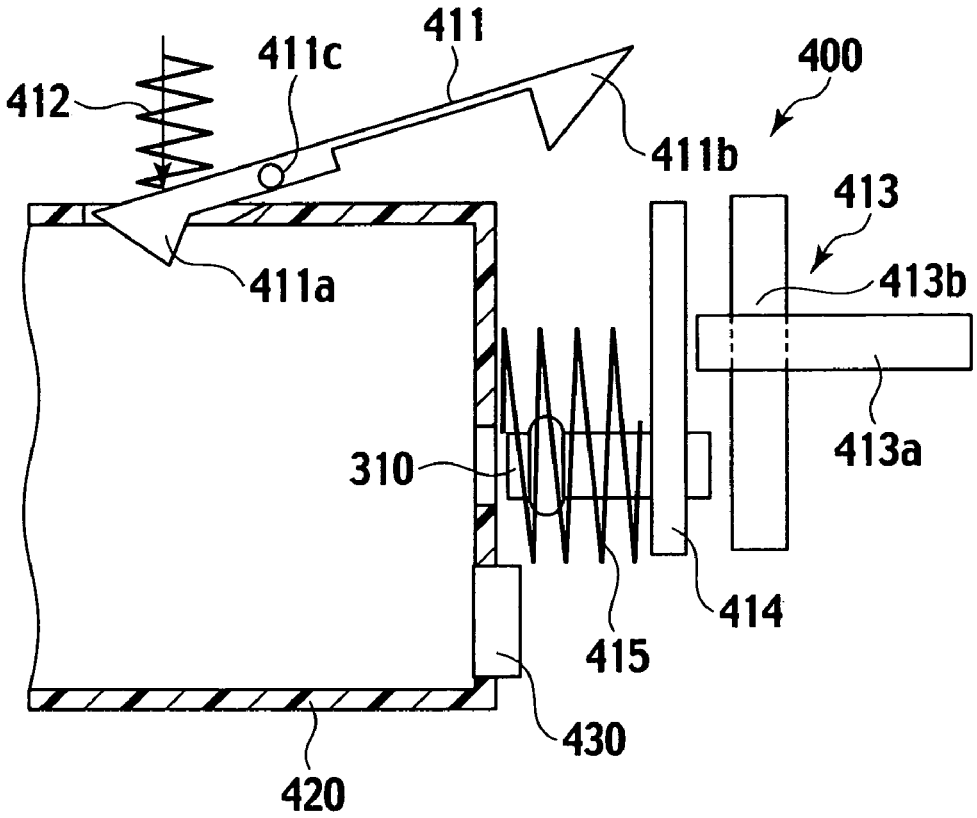
FIG. 8A is a schematic side view of the detachable structure (before cartridge insertion)
Figure 8B:
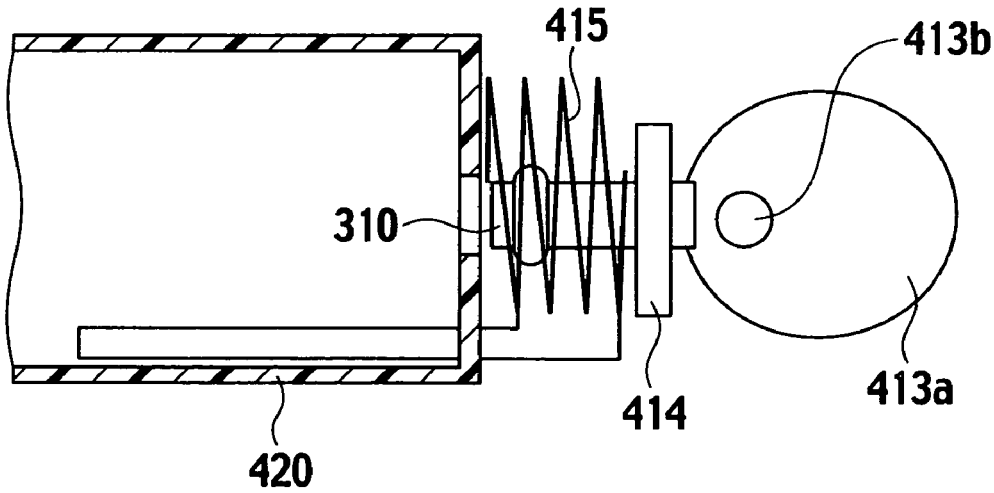
FIG. 8B is a schematic plan view of the detachable structure (before cartridge insertion)

As shown in FIGS. 8A and 8B, the cartridge pawl 411*a* projects into the inside of a cartridge container 420 through an opening due to a pressing force of a spring 412 under a state with no ink cartridge 200.

Figure 9A:
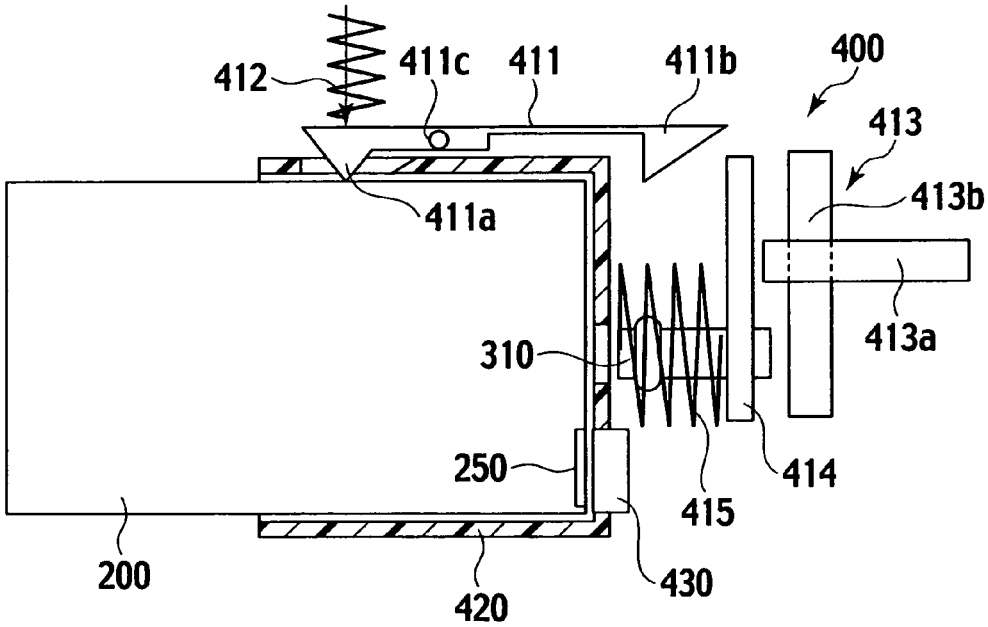
FIG. 9A is a schematic side view of the detachable structure (at cartridge insertion)
Figure 9B:
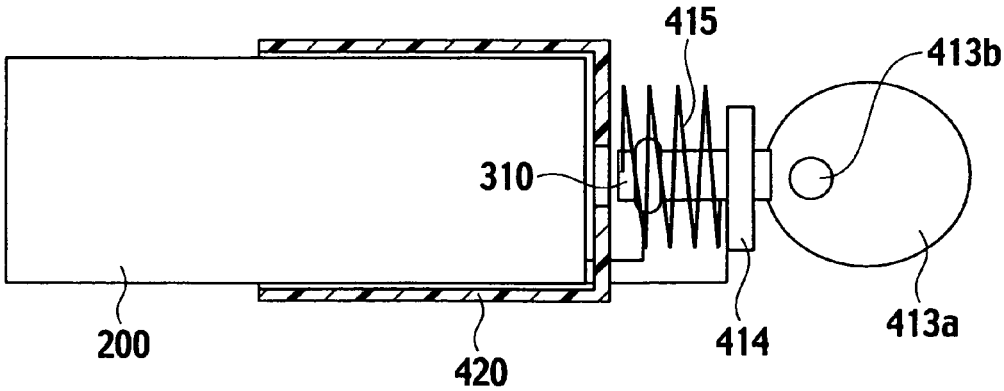
FIG. 9B is a schematic plan view of the detachable structure (at cartridge insertion)

After the ink cartridge 200 is inserted into the cartridge container 420, the ink cartridge 200 is contacted with the cartridge pawl 411*a* and thereby the cartridge pawl 411*a* is moved upward against a repelling force by the spring 412 (see FIGS. 9A and 9B). Since the cartridge pawl 411*a* is moved upward, the joint lock plate 411 swings about the support point 411*c* to locate the opposite joint pawl 411*b* at a position for hooking a coupled plate 414 (see FIGS. 10A and 10B). Note that, when the ink cartridge 200 is installed, the cartridge pawl 411*a* is hooked with the connector 212 on the ink cartridge 200 so as to prevent unexpected detachment of the ink cartridge 200.

In addition, the joint lock plate 411 swings about the support point 411*c* due to upward moving of the cartridge pawl 411*a*. As a result, the spring 412 is compressed and thereby it generates an elastic restoring force to press the joint lock plate 411 (the cartridge pawl 411*a*) onto the ink cartridge 200. When the ink cartridge 200 is pulled out, the lock plate 411 swings back and thereby the joint pawl 411*b* is unhooked from the coupled plate 414.

The return spring 415 functions as an uncoupling unit that uncouples the holder 310 from the ink supply port 230 when the joint lock plate 411 is unhooked. When the joint lock plate 411 is released, the return spring 415 separates the holder 310 from the ink supply port 230 by its elastic restoring force.

The coupling cam 413 functions as a joint coupling unit that couples the holder 310 with the ink supply port 230 when it is determined that the cartridge information is valid. The coupling cam 413 includes a circular plate 413*a* and a rotational axis rod 413*b*. The rotational axis rod 413*b* penetrates the circular plate 413*a* perpendicularly. These two elements are fixed eccentrically. In other words, the center of the rotational axis rod 413*b* is not coincident with the center of the circular plate 413*a*. Note that the circular plate 413*a* may have an ellipsoidal outer shape.

When the cartridge information of the installed ink cartridge 200 is valid, the rotational axis rod 413*b* is rotated. Thus, the largely eccentric side of the circular plate 413*a* pushes the coupled plate 414 integrated with the holder 310 to move the holder 310 toward its coupled position.

Figure 10A:
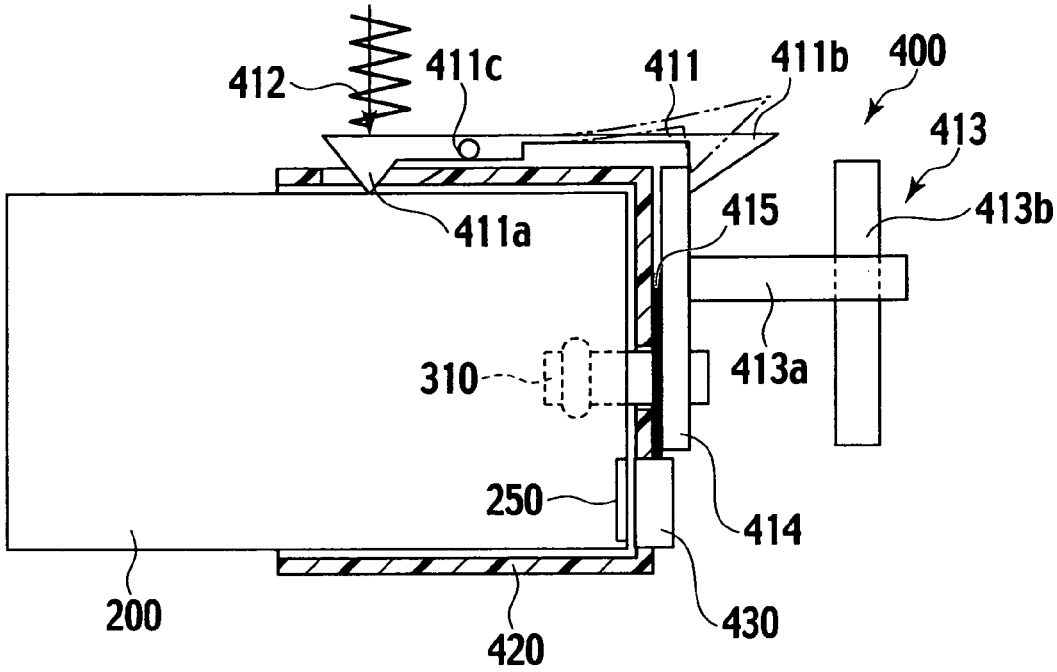
FIG. 10A is a schematic side view of the detachable structure (during coupling)
Figure 10B:
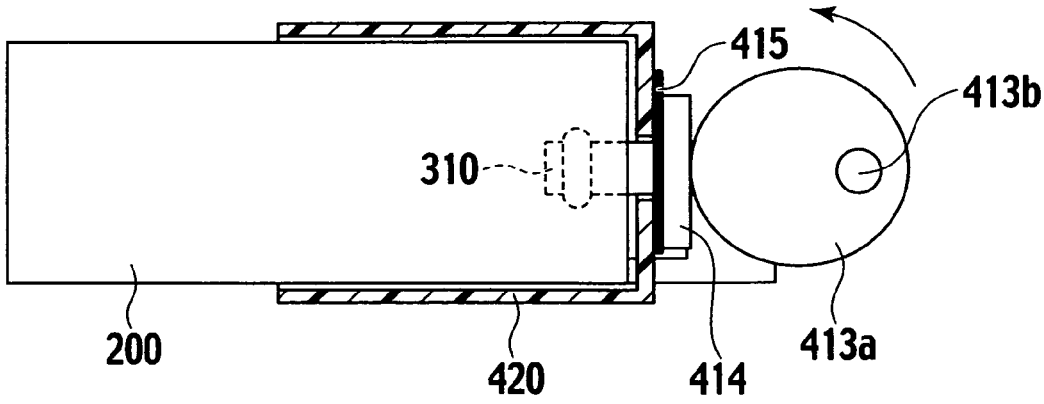
FIG. 10B is a schematic plan view of the detachable structure (during coupling)

When the holder 310 is moved to the deepest coupled position due to the above-mentioned rotation of the circular plate 413*a*, the coupled plate 414 is hooked by the joint pawl 411*b* of the joint lock plate 411 (see FIGS. 10A and 10B). The circular plate 413*a* is continuously rotated to its default position and then stopped (see FIGS. 11A and 11B). In this state, there is a distance between the circular plate 413*a* and the coupled plate 414. In addition, the return spring 415 urges the holder 310 but the holder is held at its coupled position by an engagement between the joint pawl 411*b* of the joint lock plate 411.

On the other hand, when the ink cartridge 200 is pulled out from the cartridge container 420, the cartridge pawl 411*a* is unlatched from the connectors 212 (shown in FIGS. 5A and 5B) and then the joint lock plate 411 swings back due to the elastic restoring force of the spring 412. As a result, the joint pawl 411*b* is unhooked from the coupled plate 414. Therefore, the holder 310 is moved back to its uncouple position due to the elastic restoring force by the return spring 415. The holder 310 is separated from the ink supply port 230 (see FIGS. 8A and 8B).

(Attaching/Detaching Method of Ink Cartridge in Printer)

Figure 12:
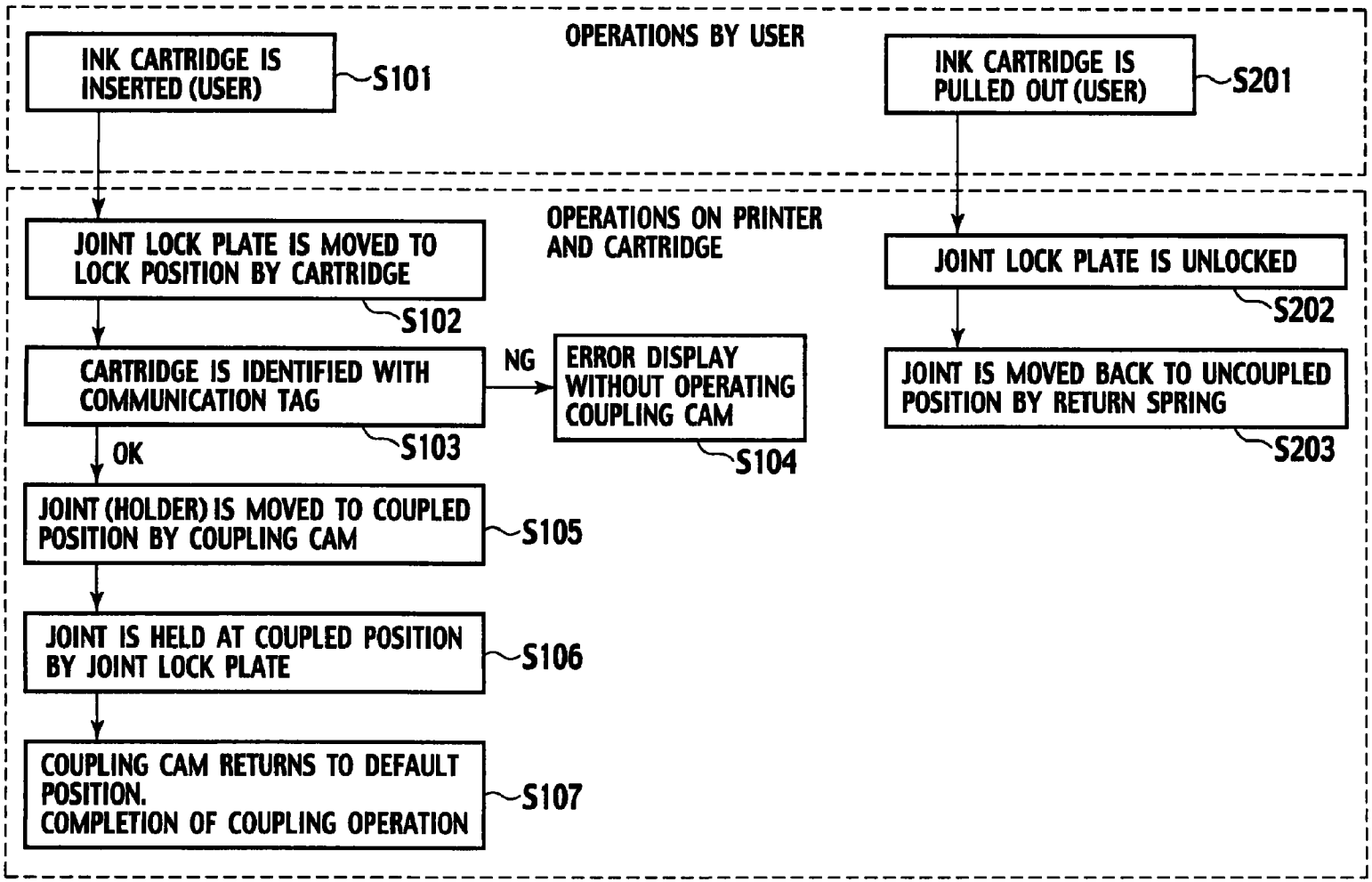
FIG. 12 is a flow chart showing processes of attaching/detaching method of an ink cartridge in the printer according to the embodiment of the present invention.

Next, an attaching/detaching method of the ink cartridge 200 will be explained with reference to a flow chart shown in FIG. 12.

When a user inserts the ink cartridge 200 (S101), the joint lock plate 411 is moved toward its lock position (S102) as shown in FIGS. 9A and 9B.

The cartridge information acquisition unit 332 acquires the information on the ink cartridge 200 from the communication tag 250 via the wireless communication I/F 430. The acquired information is validated by the cartridge information determining unit 333 (S103).

More specifically, the wireless communication I/F 430 is provided on the cartridge container 420 so that it may locate near the communication tag 250 of the installed ink cartridge 200, as shown in FIGS. 9A and 9B. Therefore, upon installing the ink cartridge 200, the cartridge information acquisition unit 332 can acquire the information on the ink cartridge 200 from the communication tag 250 via the wireless communication I/F 430.

If the cartridge information is invalid ("NG" in S103), the coupling cam 413 is not driven and an error message is displayed (S104). On the other hand, if the cartridge information is valid ("OK" in S103), the cartridge information determining unit 333 drives the coupling cam 413 to rotate the circular plate 413*a*. Thus, the circular plate 413*a* pushes the coupled plate 414 to move the holder 310 toward its coupled position (S105).

At this time, the joint lock plate 411 is elastically bent by the moving coupled plate 414 so as to move the joint pawl 411*b* upward and then restores its shape due to its elastic restoring force to latch the coupled plate 414 by the joint pawl 411*b*. When the joint lock plate 411 locates at its lock position, the ink cartridge 200 received a pressure from the spring 412 with interposing the cartridge pawl 411*a*. In addition, when the joint lock plate 411 locates at its lock position, the holder pawl 411*b* holds the coupled plate 414 and the holder 310 is held at its coupling position with the ink supply ports 230. In other words, the joint sections 232 and 313 (see FIGS.

5A and 5B) are held in the coupled state. Therefore, the ink cartridge 200 is held in its coupled state (FIGS. 10A and 10B) (S106).

Figure 11A:
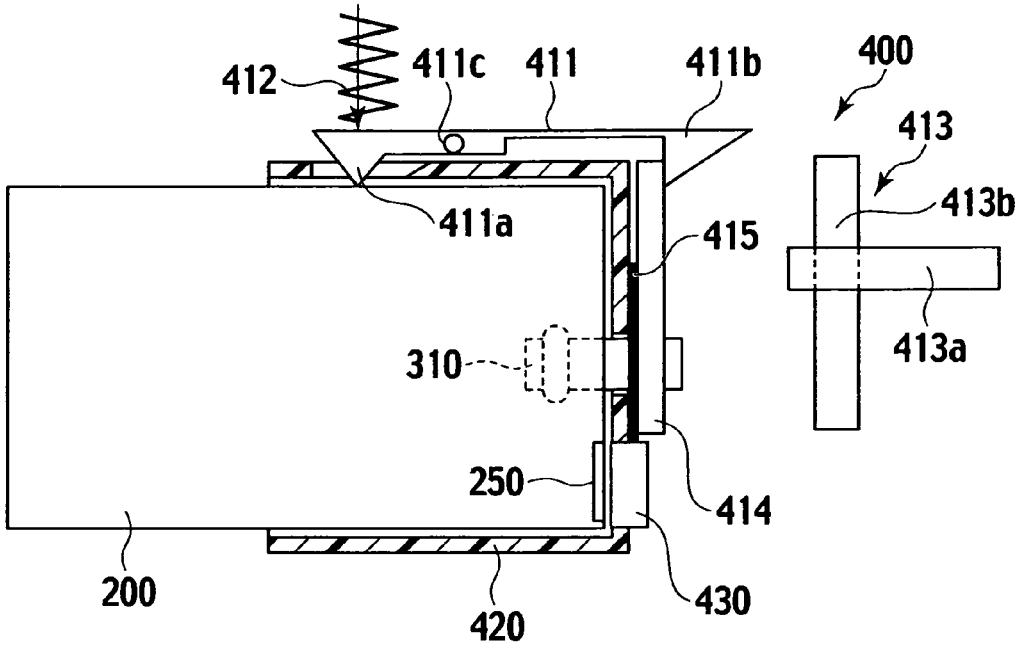
FIG. 11A is a schematic side view of the detachable structure (after coupling)
Figure 11B:
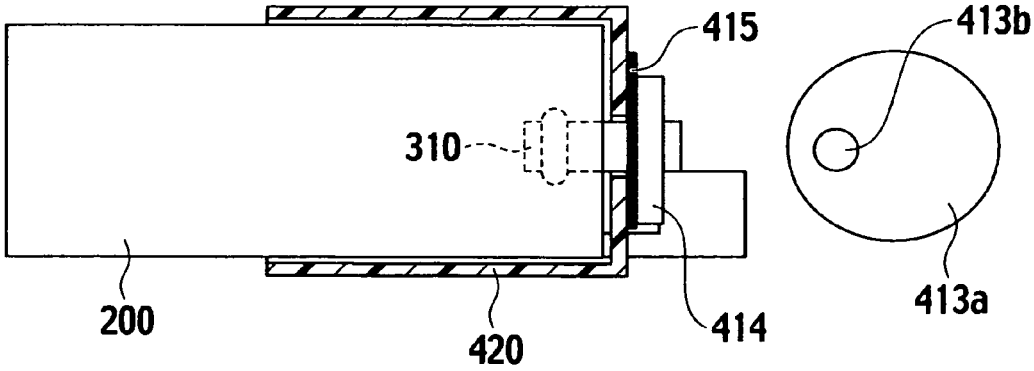
FIG. 11B is a schematic plan view of the detachable structure (after coupling)

Then, the coupling cam 413 is further rotated from the position where the circular plate 413*a* contacts with the coupled plate 414 (FIGS. 10A and 10B) to its default position where the circular plate 413*a* are separated with the coupled plate 414 (FIGS. 11A and 11B). In this manner, the coupling operation is completed (S107).

Specifically, the ink cartridge 200 is fixed by the pressing force of the spring 412 and the joint pawl 411*b* that functions as the portion for holding the coupled state. This fixture is achieved by hooking the cartridge pawl 411*a* with the connectors 212 (see FIGS. 2A and 2B). Under the coupled state of the ink cartridge 200, the return spring 415 is in a state with being compressed by (receiving a pressure from) the ink cartridge 200.

Next, another case where the ink cartridge 200 is pulled out will be explained. From the coupled state of the ink cartridge 200 (FIGS. 11A and 11B), the ink cartridge 200 is pulled out (S201).

When the ink cartridge 200 is pulled out, the joint lock plate 411 returns from its lock position (FIGS. 11A and 11B) to its default position (FIGS. 8A and 8B) (S202).

In this process, the coupled plate 414 that was held by the joint lock plate 411 is released. Then, the return spring 414 pushes the coupled plate 414 due to its restoring force and separates the holder 310 from the cartridge container 420 (S203).

Specifically, when the ink cartridge 200 is removed, the joint lock plate 411 is swung about the support point 411*c* by the restoring force of the spring 412 so as to unhook the joint pawl 411*b* that functions as the portion for holding the coupled state. As a result, the holder 310 is separated from the ink supply port 230 of the ink cartridge 200 due to the restoring force of the compressed return spring 415.

According to the present embodiment, the validity of the attached ink cartridge 200 is judged based on the information on the ink cartridge 200 stored in the storing unit 250. If it is judged that the information is valid, the joint section 313 of the holder 310 is driven so as to be coupled with the ink supply port 230 of the ink cartridge 200. On the other hand, if it is judged that the information is invalid, the ink cartridge 200 is not coupled with the joint section 313 of the holder 310 (the joint section 313 is not driven) to prohibit ink supply. Therefore, prevented can be undesirable ink mixture due to an erroneous installation of the ink cartridge by a user.

Here, the joint lock plate 411 holds the coupled state of the joint section 313 and the ink supply port 230 due to the insertion force of the ink cartridge 200. Since the pressing force generated on the basis of a user's manual operation can be utilized effectively, no additional special drive source is needed to set and keep the joint lock plate 411 in its lock position.

In addition, the coupling cam 413 sets the joint section 313 in the coupled state with the joint lock plate 411. Under the coupled state of the joint section 313, the return spring 415 is compressed. Then, the coupling cam 413 is made distanced from the joint section 313 while the coupled state is being held. After the coupling cam 413 is distanced from the joint section 313, the coupled state of the ink cartridge 200 is maintained. Therefore, stable ink supply can be achieved.

At the time when a user removes the ink cartridge 200, the coupling cam 413 is separated from the joint section 313. Therefore, when the joint lock plate 411 is released due to removal of the ink cartridge 200, the joint section 313 is separated from the ink supply port 230 by the restoring force of the return spring 415. After that, another ink cartridge 200 can be attached to the printer 100 (coupled with the holder 310) correctly only after the validity of the other ink cartridge 200 is certified. Therefore, even in a case where electrical power supply is shut down and thereby the validity cannot be certified by an electrical communication or information processing, prevented can be undesirable ink mixture due to an erroneous installation of the ink cartridge 200 by a user.

What is claimed is:

1. A detachable structure for an ink cartridge in a printer, the structure comprising:

a storing unit provided on the ink cartridge for storing information on the ink cartridge;

an acquisition unit provided on the printer for acquiring the information stored in the storing unit when the ink cartridge is attached onto the printer;

a determining unit provided on the printer, which receives information from the acquisition unit, for certifying validity of the information acquired by the acquisition unit; and an ink supply control unit, provided on the printer, for supplying ink from the ink cartridge to the printer when the validity of the information is certified by the determining unit, the ink supply control unit comprising:

a joint section to be coupled with an ink supply port of the ink cartridge;

a joint coupling unit for coupling the joint section with the ink supply port when the validity of the information is certified by the determining unit.

2. The detachable structure according to claim 1, wherein the ink supply control unit includes further comprising:

a state holding unit for holding a coupled state of the joint section and the ink supply port; and an uncoupling unit for uncoupling the coupled state by separating the joint section from the ink supply port when the state holding unit stops holding.

3. The detachable structure according to claim 2, wherein the state holding unit starts to hold the coupled state of the joint section and the ink supply port by an attachment force of the ink cartridge onto the printer.

4. The detachable structure according to claim 2, wherein the uncoupling unit separates the joint section from the ink supply port when the state holding unit stops holding due to detachment of the ink cartridge from the printer.

5. The detachable structure according to claim 4, wherein the joint coupling unit is made distanced with the joint section after the state holding unit starts holding the coupled state of the joint section and the ink supply port, and the uncoupling unit is deformed under the coupled state and separates the joint section from the ink supply port by a restoring force thereof.

6. A control method for attaching/detaching an ink cartridge in a printer, the control method comprising:

(a) storing information on the ink cartridge in a storing unit provided on the ink cartridge;

(b) acquiring, on the printer, the information stored in the storing unit when the ink cartridge is attached onto the printer;

(c) certifying, on the printer, validity of the information acquired by the acquisition unit; and (d) supplying ink from the ink cartridge to the printer when the validity of the information is certified in (c) by moving a joint section of the printer towards an ink supply port of the ink cartridge to couple the joint section with the ink supply port.

7. The control method according to claim 6, wherein (d) further includes holding a coupled state of the joint section and the ink supply port using a state holding unit; and the control method further comprises (e) uncoupling the coupled state by separating the joint section from the ink supply port when the state holding unit stops holding.

8. The control method according to claim 7, wherein the state holding unit starts to hold the coupled state of the joint section and the ink supply port by an attachment force of the ink cartridge onto the printer.

9. The control method according to claim 7, wherein the joint section is, in (e), separated from the ink supply port when the state holding unit stops holding due to detachment of the ink cartridge from the printer.

10. The control method according to claim 9, wherein an uncoupling unit is provided on the printer for achieving (e), and the uncoupling unit is deformed under the coupled state and separates, in (e), the joint section from the ink supply port by a restoring force thereof.

* * * * *

UNITED STATES PATENT AND TRADEMARK OFFICE

CERTIFICATE OF CORRECTION

PATENT NO. : 8,215,754 B2
APPLICATION NO. : 12/588031
DATED : July 10, 2012
INVENTOR(S) : Akiyama It is certified that error appears in the above-identified patent and that said Letters Patent is hereby corrected as shown below:

Column 12, Claim 2, Line 32
Please delete "includes"
Line should read "...control unit further comprising:"

Signed and Sealed this
Twenty-fifth Day of December, 2012

David J. Kappos

David J. Kappos
*Director of the United States Patent and Trademark Office*